United States Patent [19]

Mapes

[11] Patent Number: 4,776,820

[45] Date of Patent: Oct. 11, 1988

[54] BILGE WATER PUMP MECHANISM FOR OUTBOARD MOTOR COWL

[75] Inventor: Charles W. Mapes, Oshkosh, Wis.

[73] Assignee: Brunswick Corporation, Skokie, Ill.

[21] Appl. No.: 82,813

[22] Filed: Aug. 6, 1987

[51] Int. Cl.[4] ..... B63H 5/12

[52] U.S. Cl. ..... 440/88

[58] Field of Search ..... 440/88, 89, 900; 123/198 C, 41.08; 417/199 R, 338, 339, 343

[56] References Cited

U.S. PATENT DOCUMENTS

| | | | |
|---|---|---|---|
| 2,308,746 | 1/1943 | Flint | 123/198 C |
| 4,403,972 | 9/1983 | Bland et al. | 440/88 |
| 4,569,415 | 2/1986 | Breckenfeld et al. | 123/198 C |

*Primary Examiner*—Joseph F. Peters, Jr.

*Assistant Examiner*—Jesûs D. Sotelo

*Attorney, Agent, or Firm*—Andrus, Sceales, Starke & Sawall

[57] ABSTRACT

A pump mechanism continuously operable by the engine of an outboard motor for discharging water that collects by seepage or leakage into the engine cowl. The pump mechanism includes an inlet conduit having an inlet end positioned closely adjacent to the bottom of an inclined channel formed in the lower section of the engine cowl, and an outlet conduit having an outlet end positioned exteriorly of the cowl. A filter disposed in the inlet conduit removes debris from the water and protects the pump mechanism, and a bracket mounted to the engine block holds the inlet end of the inlet conduit closely adjacent to the bottom of the channel.

6 Claims, 2 Drawing Sheets

BILGE WATER PUMP MECHANISM FOR OUTBOARD MOTOR COWL

BACKGROUND OF THE INVENTION

The present invention relates to marine drives, and more particularly to a pumping mechanism for pumping bilge water out of the engine compartment of an outboard motor.

The engine of an outboard motor is surrounded by a cowl which, of necessity, must provide numerous openings and passages therethrough. For example, there are openings to permit a supply of air to the engine, an opening for accommodating the pull cord for starting the engine, an opening to permit entry of throttle and shift cables, and the like. During operation, such openings, although closed by seals, may at times allow seepage to leakage of water into the engine compartment. Additionally, the motor cowling oftentimes may become partially submerged for a short time as, for example, when a boat comes down off plane, when a boat is launched from a trailer, or during heavy wave conditions. When the motor cowling becomes partially or totally submerged, water may enter the engine compartment and accummulate in the lower section of the motor cowling.

It would thus be desirable to provide a device which would pump and discharge any accummulated water from the motor cowling to a location outside of the motor cowling while not allowing ingress of water into the engine compartment should the motor cowling become partially or totally submerged. This is especially desirable for outboard motors carried out behind a boat wholly aft of the boat transom since the motor cowlings of these outboard motors usually are somewhat closer to the water than those mounted directly on the boat transom.

Various types of pump and/or drain assemblies for outboard motors are known, and attention is directed to the following U.S. patents relating to such arrangements:

| U.S. Pat. No. | Inventor | Issue Date |
|---|---|---|
| 4,533,331 | Bland | Aug. 6, 1985 |
| 4,518,363 | Bland et al | May 21, 1985 |
| 4,403,972 | Bland et al | Sep. 13, 1983 |

SUMMARY OF THE INVENTION

A pump mechanism for discharging bilge water from the engine compartment of a marine drive outboard motor.

A pump mechanism continuously operable by the engine of an outboard motor for discharging water that collects by seepage or leakage into the engine cowl. The pump mechanism includes an inlet conduit having an inlet end positioned closely adjacent to the bottom of an inclined channel formed in the lower section of the engine cowl, and an outlet conduit having an outlet end positioned exteriorly of the cowl. A filter disposed in the inlet conduit removes debris from the water and protects the pump mechanism, and a bracket mounted to the engine block holds the inlet end of the inlet conduit closely adjacent to the bottom of the channel.

Preferably, the channel is inclined toward the rearward end of the engine cowl, and is U-shaped to extend along opposite sides and rearwardly of the engine. In one form, the pump means is of the diaphragm type and is operable by rotation of a cam on the engine crankshaft.

The present invention thus provides a pump mechanism for discharging water from the engine compartment of an outboard motor while not allowing water to return if the motor is partially or totally submerged. The pump mechanism is continuously operable by the engine and thus avoids the inherent disadvantages of prior art floating ball type drain valves whose operation may become erratic when the environment departs from a new, clean condition due to debris accumulation. Other features and advantages of the invention will become apparent to those skilled in the art upon reviewing the following detailed description, the drawings, and the appended claims.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
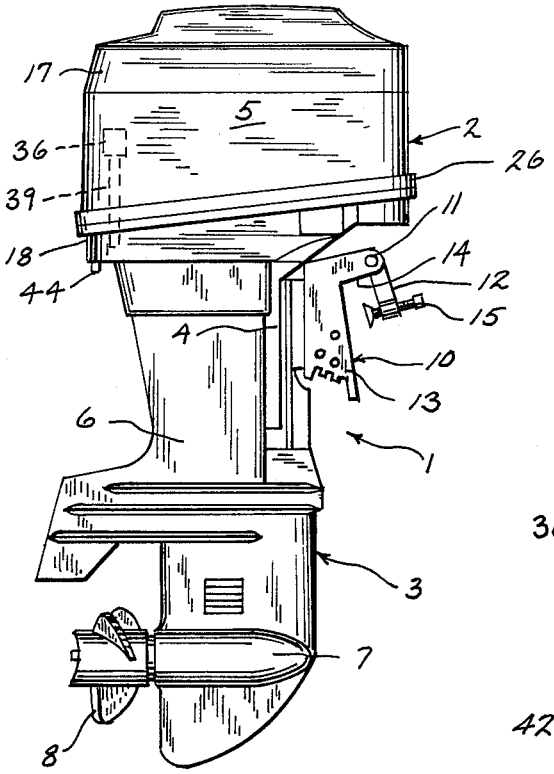
FIG. 1 is a side view in elevation illustrating an outboard motor which incorporates a pump mechanism in accordance with the present invention.

Referring now to the drawings, FIG. 1 illustrates a marine propulsion drive in the form of an outboard motor 1 having a propulsion assembly including an upper unit or powerhead 2, a lower unit 3 and a swivel bracket 4. Upper unit 2 includes a cover or cowl 5 defining an engine compartment for housing an internal combustion engine 9 (see FIG. 2).

Lower unit 3 is rigidly mounted to the bottom of the powerhead or upper unit 2 and includes a drive shaft housing 6 and a gear case 7. Gear case 7 is normally submerged in the water and supports a rotatable propeller shaft carrying a propeller 8. Gear case 7 houses a suitable reversing transmission which drivingly connects propeller 8 to a drive shaft extending through the drive shaft housing 6 which drivingly interconnects engine 9 and propeller 8.

Lower unit 3 is connected to swivel bracket 4 for swivel or swinging movement about a vertical axis and in a horizontal plane to provide steering control for outboard motor 1.

Outboard motor 1 is supported from a transom or other supporting member of a boat hull by a mounting assembly comprising a transom bracket 10 on which swivel bracket 4 is mounted. Outboard motor 1 including swivel bracket 4 is connected to transom bracket 10 for pivotal or tilting movement about a horizontal transverse axis and in a vertical plane between an operating position wherein gear case 7 and propeller 8 are fully submerged in water, and the tilted or non-operating position wherein gear case 7 and propeller 8 are raised from the water, as for trailering.

Transom bracket 10 includes two spaced apart inverted U-shaped clamp members or mounting members (only one of which is shown in FIG. 1) for removably mounting outboard motor 1 to the boat transom. The clamp members of transom bracket 10 are interconnected by a pivot pin or tilt shaft 11 which extends substantially horizontally between the upper ends of the clamp members. Each inverted U-shaped clamp member has an upper body portion with an integral inside leg 12, and an outside leg 13 extending downwardly thereform and defining a transom receiving opening 14 therebetween. Transom receiving opening 14 may be of any desired width sufficient to enable the engine to be readily installed over transoms of any thickness within a desired range. Transom bracket 10 and thus outboard motor 1 may be removably mounted and secured to the boat transom by means of bolts 15 in the convention manner.

Figure 2:
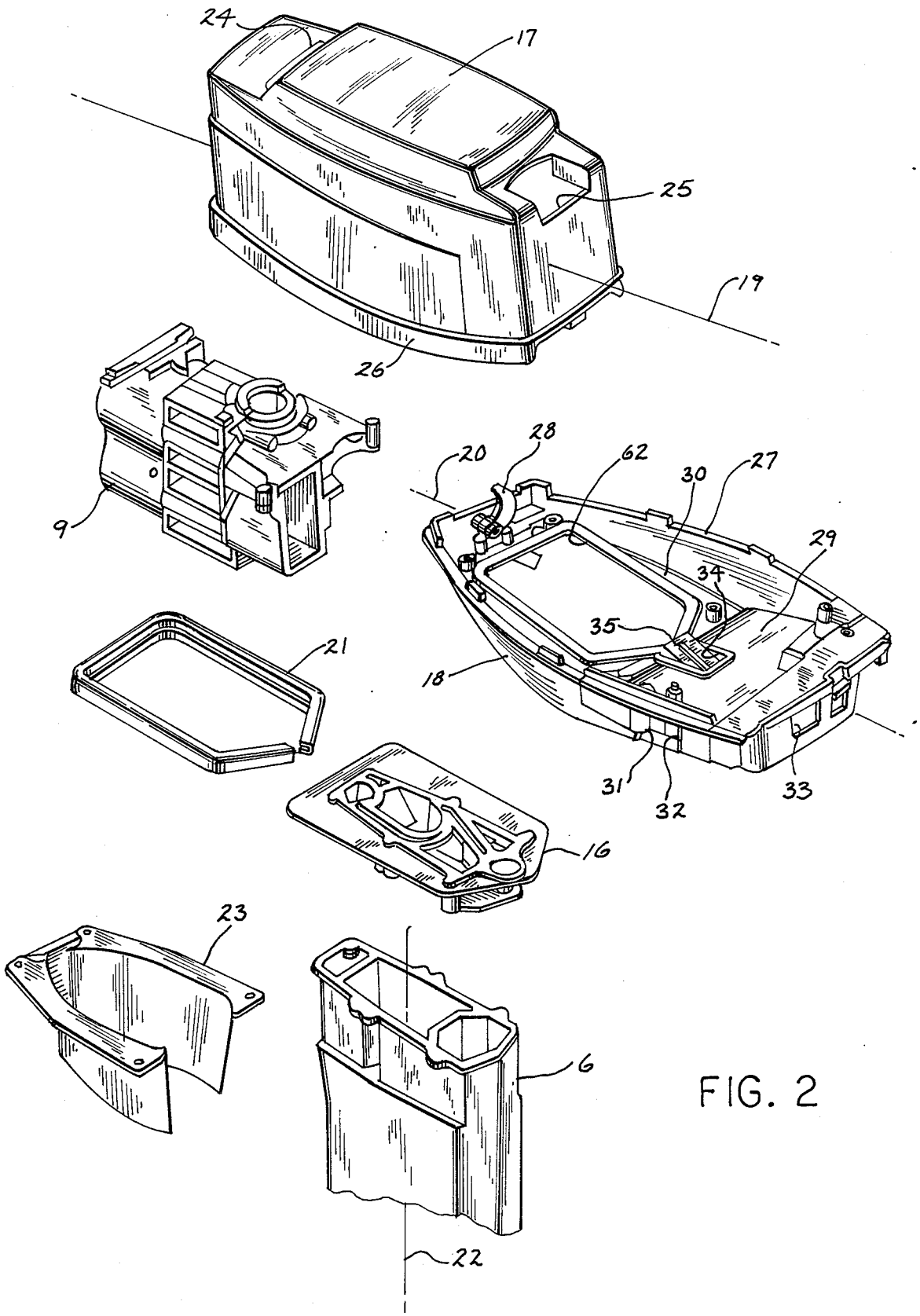
FIG. 2 is an exploded view illustrating the components of the outboard motor of FIG. 1.

Referring now to FIG. 2, there is illustrated in more detail the various components of outboard motor 1. More particularly, engine 9 is adapted for mounting on an adapter plate 16, which is adapted for mounting to the upper end of driveshaft housing 6. Cowl 5 includes an upper cowl section 17 and a lower cowl section 18 which forms an engine compartment for housing engine 9 of outboard motor 1. Upper cowl section 17 and lower cowl section 18 extend generally along parallel and co-planar longitudinal front-rear axes 19 and 20, respectively. Lower cowl section 18 includes an opening 62 adapted to receiver adapter plate 16 and provide a water tight seal with gasket 21 which is received about the peripheral edges of adapter plate 16. Thus, engine 9 is positioned above adapter plate 16 so as to be contained within the cavity or engine compartment formed by upper cowl section 17 and lower cowl section 18 when fit together, and substantially in alignment with a vertical axis 22 extending through drive shaft housing 6. A one piece lower skirt 23 is placed against the bottom of adapter plate 16 to sandwich adapter plate 16 between lower cowl section 18 and skirt 23. One piece skirt 23 is then attached to the underside of lower cowl section 18 using a series of bolts (not shown).

Upper cowl section 17 includes an air intake 24 at its rearward end and a rectangular shaped opening 25 at forward end for receiving the pull cord assembly for manually starting engine 9. A gasket 26 is disposed along the lower edge of upper cowl section 17 to sealingly engage in water tight relationship with the upper edge 27 of lower cowl section 18 when connected thereon by latch 28. Lower cowl section 18 includes a bottom wall 29 inclined rearwardly to a U-shaped channel 30 which extends along opposite sides and the rear of engine 9. Channel 30 is also inclined rearwardly as best shown in FIG. 1 so that the rear section of channel 30 adjacent latch 28 is the lowermost point within the engine compartment which may collect water that might leak or seep therein. As shown best in FIG. 2, lower cowl section 18 also includes a side opening 31 for receiving a throttle cable and shift cable for engine 9. Opening 31 is sealed by a gasket 32 to prevent water from entering the engine compartment. Lower cowl section 18 also includes a foward opening 33 therein for receiving a choke control (not shown) which is also sealed by means of a gasket (not shown). Additionally, an opening 34 is formed in bottom wall 29 through which a shift rod (not shown) extends. As shown, opening 34 is sealed by means of a gasket 35.

In its assembled form, cowl 5 is intended to provide a water tight engine compartment for engine 9. For this purpose gaskets 21, 26, 32 and 35 are employed as well as gaskets for sealing openings 25 and 33. Additionally, water is separated from the intake air by water separators (not shown) within cowl 5. However, cowl 5 oftentimes because partially submerged for a short time, as, for example, when a boat comes down off plane, when a boat is launched from a trailer, or during heavy wave conditions. When the cowl 5 becomes partially or totally submerged, water may enter the engine compartment through the various openings and gaskets noted above and accumulate at the bottom of lower cowl section 18. However, due to the rearwardly inclined bottom wall 29 and U-shaped channel 30 this bilge water is directed rearwardly to the rearwardmost portion of channel 30 which is adjacent latch 28.

Figure 3:
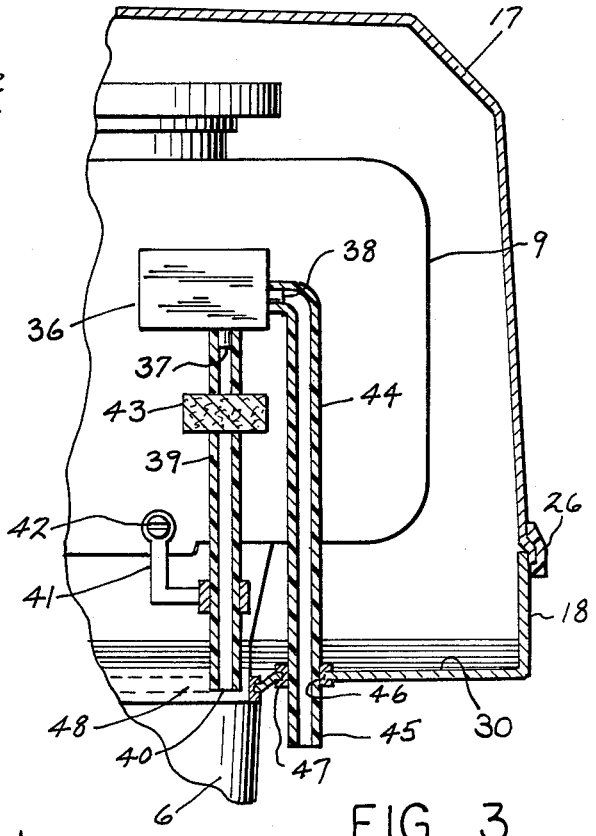
FIG. 3 is an enlarged cross sectional view of a portion of the engine compartment of the outboard motor of FIG. 1 illustrating the pump mechanism.

Referring now to FIG. 3, there is shown a pumping mechanism for continuously removing this bilge water from channel 30 and for discharging the water exteriorly of cowl 5. The means for removing water from channel 30 includes a pump 36 mounted on the engine block of engine 9 which includes an inlet 37 and an outlet 38. An inlet conduit 39 has its inlet or intake end 40 positioned closely adjacent the bottom of channel 30 and its opposite end connected to inlet 37. The intake end 40 of conduit 39 is held in its position closely adjacent to the bottom of channel 30 by means of a bracket 41 having one end surrounding conduit 39 and its other end mounted to the engine block of engine 9 by means of a mounting screw 42. A filter 43 is also positioned within inlet conduit 39 for removing debris from the bilge water sucked up through conduit 39 by pump 36 so as to protect pump 36. An inlet conduit 44 has one end connected to outlet 38 of pump 36 and has its opposite or discharge end 45 extending through an opening 46 formed in the bottom of channel 30 so as to discharge water flowing from pump 36 exteriorily of cowl 5. Opening 46 is sealed in a watertight relationship by means of a gasket 47 which also aides in holding outlet conduit 44 therein. Thus, bilge water, represented by the numeral 48, is sucked up through conduit 39 by pump 36 and is discharged overboard exteriorly of cowl 5 by means of outlet conduit 44.

Figure 4:
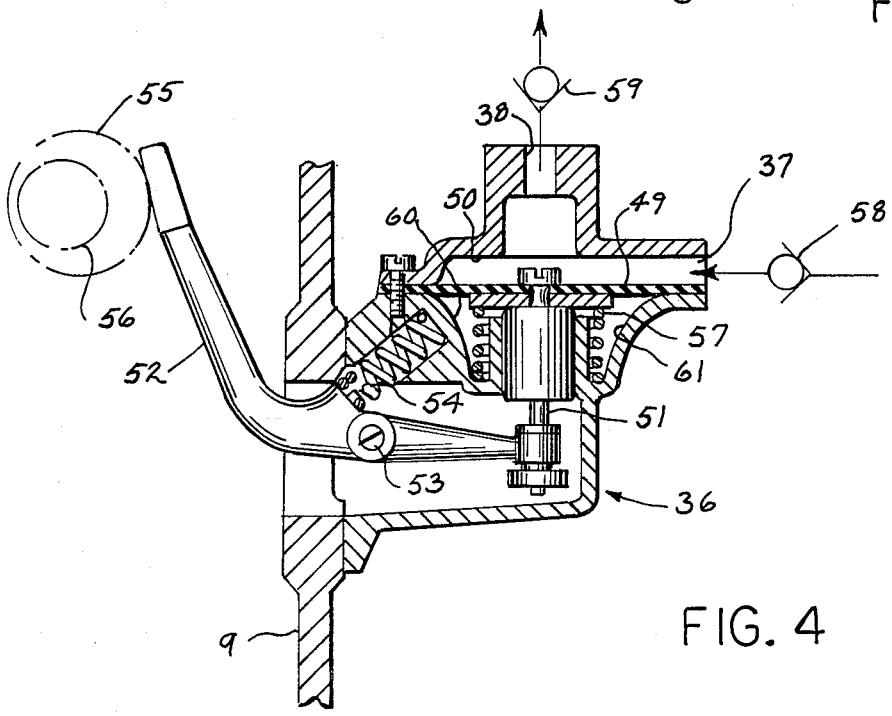
FIG. 4 is an enlarged cross section view illustrating a mechanically driven diaphragm pump for use with the pumping mechanism of FIG. 3.

Referring now to FIG. 4, there is illustrated one form of pump 36. As illustrated, pump 36 is a mechanically driven diaphragm type pump which includes a diaphragm 49 disposed within a pump chamber 50. Diaphragm 49 is connected via piston rod 51 to one end of a reciprocable lever 52 which pivots at 53 and is biased to a counter-clockwise position by a spring 54. The opposite end of lever 52 is in engagement with a cam 55 mounted on a rotatable crankshaft 56 for engine 9. Pump 36 is mounted on the wall of the engine block of engine 9 and includes a coil spring 57 for biasing diaphragm 49 in the position shown in FIG. 4, and further includes an inlet check valve 58 and an outlet check valve 59.

In operation, as the high point of cam 55 pushes lever 52 toward pump 36, lever 52 fulcrums at pivot point 53 thereby pulling diaphragm 49 downwardly. A vacuum or suction is thereby created in chamber 50. This vacuum opens the inlet check valve 58 and draws bilge water 48 from channel 30 through inlet conduit 39. At this point, outlet check valve 59 is closed and a chamber 60 in which spring 57 is located is open to the atmosphere through breather hole 61. As crankshaft 56 rotates further, the lower point of cam 55 rotates adjacent the end of lever 52 so that pressure is exerted on lever 52 by spring 54 to cause lever 52 to follow cam 55. At this point in time, lever 52 has rotated counterclockwise from the position shown in FIG. 4 and diaphragm spring 57 pushes diaphragm 49 upwardly to thereby force bilge water 48 in chamber 50 through outlet check valve 59 and into outlet conduit 44. Pump 36 operates continuously to discharge water from channel 30 so long as engine 9 is in operation.

A pumping mechanism for discharging bilge water out of the engine compartment of an outboard motor has been illustrated and described. Various modifications and/or substitutions may be made to the specific components described herein without departing from the scope of the invention. For example, although pump 36 is illustrated as being a mechanically driven diaphragm pump, it is readily apparent that pump 36 may also be of the electric type or of the type that works off of crankcase vacuum/pressure to pump water out of the lower cowl section.

Various modes of carrying out the invention are contemplated as being within the scope of the following claims particularly pointing out and distinctly claiming the subject matter which is regarded as the invention.

I claim:

1. A marine drive outboard motor, comprising:

an engine;

a cowl surrounding said engine including a lower section having an inclined bottom defining a channel for collecting water which may leak into the interior thereof;

a lower unit extending downwardly from said engine including a gear case carrying a propeller and a drive shaft housing carrying a drive shaft for drivingly interconnecting the engine and propeller;

pump means continuously operable by said engine for discharging water from said channel to a location exteriorly of said cowl, said pump means includes a pump, inlet means communicating between said channel and said pump, and outlet means communicating between said pump and said location exteriorly of said cowl so that said pump pumps water from said channel through said inlet means into said pump and out said outlet means; and inlet and outlet check valve means respectively disposed in said inlet and outlet means for preventing reverse flow of water through said outlet means, pump and inlet means into the interior of said cowl.

2. The marine drive of claim 1 wherein said channel is U-shaped and extends along opposite sides and rearwardly of the engine.

3. The marine drive of claim 2 wherein said pump means includes an inlet conduit having an inlet end positioned in said channel, and an outlet conduit having an outlet end positioned exteriorly of said cowl.

4. The marine drive of claim 3 further including filter means disposed in said inlet conduit for removing debris from said water.

5. The marine drive of claim 3 further including bracket means for holding the inlet end of said inlet conduit closely adjacent to the bottom of said channel.

6. The marine drive of claim 1 wherein said engine includes a rotating cam, and said pump means includes a diaphragm operable by the rotation of said cam.

* * * * *